US009395642B2

(12) United States Patent
Matsuura

(10) Patent No.: US 9,395,642 B2
(45) Date of Patent: Jul. 19, 2016

(54) IMAGE FORMING APPARATUS THAT ADJUSTS THE START TIMINGS OF TRANSFER BIAS VOLTAGE APPLICATIONS TO PREVENT NONUNIFORMITY IN PRINTED IMAGE DENSITY

(71) Applicant: CANON KABUSHIKI KAISHA, Tokyo (JP)

(72) Inventor: Taisuke Matsuura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/141,019

(22) Filed: Dec. 26, 2013

(65) Prior Publication Data

US 2014/0186064 A1 Jul. 3, 2014

(30) Foreign Application Priority Data

Dec. 26, 2012 (JP) ..... 2012-283305

(51) Int. Cl.
*G03G 15/02* (2006.01)
*G03G 15/16* (2006.01)

(52) U.S. Cl.
CPC ..... *G03G 15/0266* (2013.01)

(58) Field of Classification Search
CPC ..... G03G 15/0266
USPC ..... 399/50, 66
See application file for complete search history.

(56) References Cited

U.S. PATENT DOCUMENTS 5,978,616 A * 11/1999 Shin ..... G03G 15/0266 399/100
2004/0228659 A1* 11/2004 Nishida ..... G03G 15/0233 399/176
2005/0129421 A1* 6/2005 Onishi ..... G03G 15/757 399/38
2012/0230705 A1* 9/2012 Shimura ..... G03G 15/011 399/26

FOREIGN PATENT DOCUMENTS

JP 2002162801 A 6/2002
JP 2008008991 A 1/2008
JP 2012189886 A 10/2012

* cited by examiner

*Primary Examiner* — Walter L Lindsay, Jr.
*Assistant Examiner* — Milton Gonzalez
(74) *Attorney, Agent, or Firm* — Fitzpatrick, Cella, Harper & Scinto

(57) ABSTRACT

An image forming apparatus includes a plurality of photosensitive drums, and a controller for executing, when an absolute value of a set point of a charged potential is not higher than a predetermined threshold, an operation in a first mode in which charging bias voltages and transfer bias voltages are applied to image regions of the drums, at a preset length of time before image exposures are carried out by the exposure members and thereafter, the image exposures are carried out by the exposure members, respectively, and for executing, when the absolute value of the set point of the charged potential is higher than the predetermined threshold, an operation in a second mode in which timings of starting applications of the transfer bias voltages to the transfer members are delayed as compared with those in the first mode, respectively.

6 Claims, 9 Drawing Sheets

IMAGE FORMING APPARATUS THAT ADJUSTS THE START TIMINGS OF TRANSFER BIAS VOLTAGE APPLICATIONS TO PREVENT NONUNIFORMITY IN PRINTED IMAGE DENSITY

FIELD OF THE INVENTION AND RELATED ART

The present invention relates to an image forming apparatus such as a copying machine, a printer, a facsimile machine, and a multifunction apparatus capable of performing two or more functions of the preceding examples of an image forming apparatus.

An image forming operation of an image forming apparatus which employs an electrophotographic method or an electrostatic recording method is as follows. First, the peripheral surface of its image bearing member such as a photosensitive drum is charged to a preset potential level. Then, an electrostatic latent image is formed on the charged portion of the peripheral surface of the image bearing member. Then, this electrostatic latent image is developed into a toner image, that is, an image formed of toner. Then, the toner image is transferred by a transferring means, which is in the form of a roller (transfer roller), onto a sheet of recording medium, or an intermediary transferring member. As to the structure of an electrophotographic or electrostatic image forming apparatus, there has been known an image forming apparatus of the so-called tandem type, which has multiple image bearing members aligned in the direction parallel to the direction in which a sheet of recording medium and/or its intermediary transferring member is moved.

There is disclosed in Japanese Laid-open Patent Application No. 2002-162801 an image forming apparatus of the so-called tandem type. For cost reduction, this image forming apparatus is provided with only one electric power source (charge bias applying means) for charging the peripheral surface of an image bearing member, and this electric power source is shared with multiple charging means. That is, the single electric power source supplies all the charging devices (charging means) of the image forming apparatus with voltage. Thus, the same voltage is applied to multiple charging devices from the shared electric power source. Therefore, this image forming apparatus is lower in the cost of the electric power source.

In the case of an image forming apparatus such as the one described above, an area of the peripheral surface of its photosensitive member (drum), to which the transfer bias was applied, is different in development contrast from an area of the peripheral surface of the photosensitive member, to which the primary transfer bias was not applied. This difference in development contrast between the two areas sometimes results in the generation of the so-called "transfer memory," which causes the image forming apparatus to output an image which is nonuniform in density, and the nonuniformity of which is attributable to the "transfer memory". The following is a detailed description of the "transfer memory."

For example, in the case of an image formation process which uses a combination of negative toner (negatively charged toner) and a reversal developing method, the peripheral surface of a photosensitive drum is uniformly charged to a preset potential level VD (pre-exposure level) by a charging device (charge roller). Then, the uniformly charged portion of the peripheral surface of the photosensitive drum is scanned by a beam of light outputted by an exposing device while being modulated according to the density of a given point of an image to be formed. Consequently, the exposed point of the uniformly charged portion of the peripheral surface of the photosensitive drum reduces in potential to a level VL (post-exposure level). As a result, an electrostatic latent image is effected by the contrast in potential level between the exposed point, and unexposed point. Then, toner is adhered to the points of the peripheral surface of the photosensitive drum, the potential level of which is VL, by the development contrast which is the difference in potential level between the development bias Vdc applied by the developing device, and the potential level VL. Consequently, the electrostatic latent image is developed into a visible image, that is, an image formed of toner.

This toner image is transferred from the photosensitive drum, onto a sheet of recording medium or an intermediary transferring member, by the positive transfer bias Vt applied to the transferring means (transfer roller). During this transfer of the toner image, VD-Vt contrast, that is, the difference in potential level between the potential level VD (pre-exposure level) and transfer bias Vt, becomes larger than the VL-Vt contrast, that is, the difference in potential level between the potential level VL (post-exposure level) and transfer bias Vt. Therefore, more transfer current flows to the unexposed point (VD in potential) than to the exposed point (VL in potential).

During this transfer, positive charge is moved onto the photosensitive drum by the transfer bias Vt. As long as the amount of the positive charge transferred onto the photosensitive drum is minute, the positive charge is removed by the charge roller which is on the downstream side of the transfer roller. However, there is a limit to the movement of the positive charge in the photosensitive layer, or the surface layer, of the photosensitive drum. Therefore, if the positive charge transferred onto the photosensitive drum by the transfer voltage Vt is greater than a certain amount, it cannot be removed by the bias applied to the charge roller, even if the bias is increased.

Further, in the case of a reversal developing method which uses negative toner, a photosensitive drum is to be negatively charged. Therefore, the transfer bias, which is to be applied for the transfer of a toner image on the photosensitive drum is opposite in polarity from the electrical charge of the photosensitive drum. That is, it is positive. Thus, the application of the transfer bias to a given point of the charged portion of the peripheral surface of the photosensitive drum reduces the given point in potential. That is, as a given point of the charged portion of the peripheral surface of the photosensitive drum is subjected to the transfer bias, it becomes difficult for the effect of the transfer bias upon the given point to be erased from the given point, when the given point is moved through the charging station next time. Thus, as the charge bias is applied by the charge roller during the second rotation of the photosensitive drum, the point to which the transfer bias was applied becomes smaller in absolute value in the potential level than the point to which the transfer bias was not applied. Therefore, as a latent image is formed by the exposing device during the next rotation of the photosensitive drum, the portion of the peripheral surface of the photosensitive drum to which the primary transfer bias was applied becomes lower in potential level VL (post-exposure level), becoming therefore greater in development contrast, which is the difference in potential level between the development bias Vdc and post-exposure potential level VL. Therefore, the portion to which the primary transfer bias was applied becomes greater in the amount of toner adhesion than the portion to which the primary transfer bias was not applied. Thus, as the latent image is developed, the former becomes greater in density than the latter. In other words, the effects of the transfer bias applied during a given rotation of the photosensitive drum appear as the "transfer memory" during the immediately following rotation of the photosensitive drum.

The greater the transfer bias in value, the more likely it is for the "transfer memory" to be generated. Further, the "transfer memory" is attributable to the transfer bias which is positive in polarity. Therefore, when the negative potential level to which the photosensitive drum is charged is large in absolute value, that is, when the potential level VD is high, the "transfer memory" is less likely to be generated even if the transfer current remains the same in value. Incidentally, regarding the definition of the potential level VD (pre-exposure potential level), a statement (expression) that the potential level VD is high or low means that it is large or small in terms of absolute value.

The above described potential level VD is controlled so that the amount by which toner is adhered to the photosensitive drum remains stable at a preset value. It is a common practice to set the potential level VD to one among the proper values which are preset based on the temperature and humidity of the environment in which the main assembly of the image forming apparatus is used. The amount of the electrical charge which toner (which is actual developer) can hold is significantly affected by the temperature and humidity of an environment in which the toner is placed. Therefore, in order to keep stable the amount by which toner is adhered to the peripheral surface of the photosensitive drum to develop the electrostatic image on the peripheral surface of the photosensitive drum, the development contrast has to be set according to the amount of electric charge which the toner has. Therefore, in an environment which is low in temperature and humidity, the potential level VD is set high, because in an environment which is low in temperature and humidity, the amount of the electric charge which the toner (developer) can hold is relatively large. On the other hand, in an environment in which high in temperature and humidity, the potential level Vd is set lower, because the amount of electrical charge which toner can hold in an environment which is high in temperature and humidity is relatively small. In other words, the developing device is controlled so that the amount by which toner is adhered to the peripheral surface of the photosensitive drum per unit area remains stable at a preset value, regardless of the changes in the temperature and humidity of the environment. Thus, the "transfer memory" is more likely to be generated in the high temperature-high humidity environment, in which the potential level VD is set low, than in the low temperature-low humidity environment in which the potential level VD is set higher.

As a means for preventing the generation of the "transfer memory" such as the one described above, it is thinkable to make an image forming apparatus carry out a sequence such as the one shown in FIG. 8, which shows the charging timing and transferring timing in each of the yellow (Y), magenta (M), and cyan (C) image formation stations. FIG. 9 is a schematic drawing for showing the positional relationship of the charge roller 2 and transfer roller 5 relative to the photosensitive drum 1, in each image formation station, and also, the points in time at which a given point on the peripheral surface of the photosensitive drum arrives at the charge roller and transfer roller as the photosensitive drum is rotated in each image formation station. The image forming apparatus is structured so that the timing with which the transfer bias begins to be applied in the primary transfer station is such that the transfer bias is applied with such a timing that a given point of an area of the peripheral surface of the photosensitive drum, to which the charge bias is applied for toner image formation, arrives at the transfer station after one full rotation of the photosensitive drum after the charging of the given point, which was charged for image formation during the immediately preceding rotation of the photosensitive drum.

More specifically, only the portion of the photosensitive drum, to which the transfer bias was applied once is used for image formation so that the portion of the photosensitive drum which is to be used for image formation is uniform in the effect of the transfer bias, and therefore, can be uniformly charged to a preset potential level for image formation. That is, if an image forming apparatus is structured so that the transfer bias begins to be applied for the first time as the portion of the photosensitive drum for image formation arrives at the transfer station, the portion of the image, which corresponds to the portion of the image formation area, which extends by a length equivalent to a single full rotation of the photosensitive drum from the downstream edge of the image formation area of the photosensitive drum, is not subjected to the primary transfer bias. Therefore, this portion of the image, which is formed on the portion of the photosensitive drum during the first rotation of the photosensitive drum is different in the state of the photosensitive drum from the portion of the image during the second rotation of the photosensitive drum. That is, the two portions are different in potential level, which results in the generation of the above described "transfer memory." Therefore, the sequence shown in FIG. 8 is carried out to ensure that only the portion of the photosensitive drum, which has been subjected to the transfer bias, is used for image formation to minimize the effects of the transfer bias, to which the "transfer memory" is attributable.

As described above, in a case where a single high voltage electrical power source for the charge bias is shared by multiple image formation stations, the photosensitive drums in the multiple image formation stations are charged at the same time. Regarding the electrical power source for the transfer bias, however, there are provided multiple transfer bias power sources, one for each image formation station. Therefore, in terms of the rotational direction of the photosensitive drum, the portion of the photosensitive drum of a downstream image formation station, which is charged, but is not subjected to the transfer bias, is longer than that of an upstream image formation station. Therefore, the downstream image formation station is more likely to be affected by the transfer bias. That is, the "transfer memory" is more likely to be generated in a downstream image formation station than in an upstream image formation station.

Therefore, in a case where a high voltage power source is shared by multiple image formation stations, it is effective to apply the transfer bias in all the image formation stations with the same timing, in synchronism with the timing with which the charge bias is applied. For example, an image forming apparatus is to be designed so that the transfer bias begins to applied at roughly the same time as the portion of the peripheral surface of the photosensitive drum, to which the charge bias is applied for the first time since the beginning of an image forming operation, arrives at the transfer station.

However, if a sequence such as the one described is carried out, the length of time bias is applied to the transfer roller in a downstream image formation station becomes longer than that in an upstream image formation station. By the way, in recent years, a roller, which is made of foamed ion-conductive substance, and therefore, is inexpensive, and easy to adjust in electrical resistance, has come to be widely used. A roller, the material of which is an ion-conducive substance, is stable in electrical resistance. However, an ion-conductive substance, which easily mixes with rubber, easily absorbs humidity. Therefore, its conductivity, or electrical resistance, is significantly affected by the environmental factors such as temperature, humidity, etc. More concretely, its electrical resistance in a low temperature-low humidity environment is several hundred times greater than that in a high temperature-high humidity environment. In addition, as the roller made of an ion-conductive substance increases in the length of time electrical current is flowed through it, its ionic components localize, and therefore, it increases in electrical resistance. Thus, as the length of time bias is applied to the transfer roller in a downstream image formation station is made longer than that in an upstream image formation station, by a sequence such as the one described above, the transfer roller in the downstream image formation station significantly increases in electrical resistance during the early stage of the image forming operation.

As the transfer roller increases in electrical resistance, the voltage to be applied to provide transfer current for transferring the toner image on the photosensitive drum onto a sheet of recording medium, or the intermediary transferring member during an image forming operation, has to be increased. However, there is a limit to the capacity of the transfer power source. Therefore, if the transfer roller excessively increases in electrical resistance, it becomes impossible to apply voltage large enough to provide the current necessary for the transfer of the toner image. In other words, the apparatus fails to provide the current necessary to transfer the toner image. Thus, it becomes possible for the image forming apparatus to form an unsatisfactory image, the unsatisfactoriness of which is attributable to the transfer failure.

SUMMARY OF INVENTION

The present invention was made in consideration of the issues described above. Thus, the primary object of the present invention is to provide an image forming apparatus which is structured so that a single means for applying charging bias is shared by multiple image formation stations, and yet, can prevent the generation of the "transfer memory" and also, can reduce the length of time transfer bias has to be applied to the transferring means.

According to an aspect of the present invention, there is provided an image forming apparatus comprising a plurality of photosensitive members; charging members for being supplied with a charging bias voltage to charge surfaces of said photosensitive members at charge portions, respectively; exposure members for effecting image exposure of said photosensitive members charged by said charging members on the basis of image signals, respectively; developing devices for depositing toners onto said photosensitive members exposed by said exposure members to form toner images thereon, respectively; transfer members for being supplied with transfer bias voltages to transfer the toner images deposited on the surface of said photosensitive members by said developing devices, respectively, onto an intermediary transfer member or a recording material carried on a recording material feeding member; a common charging bias voltage source for applying the charging bias voltages to said charging members in accordance with set points of the charged potentials, respectively; transfer bias voltage sources for carrying out the applications of the transfer bias voltages to said transfer member at predetermined timings, respectively; and a controller for executing, when an absolute value of the set point of the charged potential is not higher than a predetermined threshold, an operation in a first mode in which said charging bias voltages and said transfer bias voltages are applied to the image regions of said photosensitive members, at a preset length of time before image exposures are carried out by said exposure members and thereafter, the image exposures are carried out by said exposure members, respectively, and for executing, when the absolute value of the set point of the charged potential, is higher than the predetermined threshold, an operation in a second mode in which timings of start of applications of the transfer bias voltages to said transfer members are delayed as compared with those in the first mode, respectively.

Further features of the present invention will become apparent from the following description of exemplary embodiments (with reference to the attached drawings).

BRIEF DESCRIPTION OF DRAWINGS

FIGS. 2A and 2B are schematic sectional views of the combination of the transfer roller, and the mechanism for placing the transfer roller in contact with the intermediary transfer roller, or separating the transfer roller from the intermediary transfer roller, in the first embodiment, and shows the operation of the mechanism, in which FIG. 2A shows a state in the full color mode, and FIG. 2B shows a state in the monochromatic mode.

DESCRIPTION OF THE EMBODIMENTS

Embodiment 1

Figure 1:
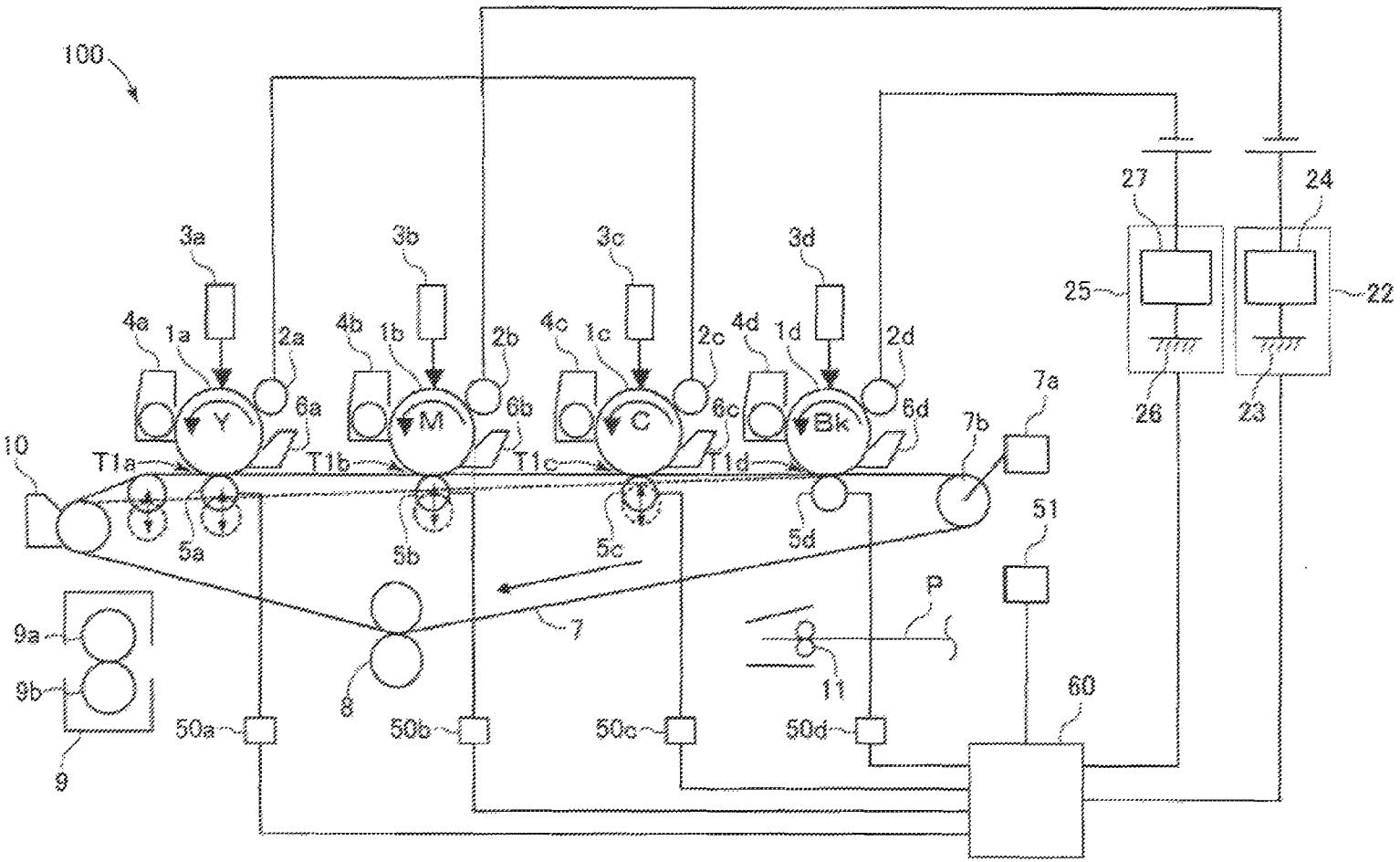
FIG. 1 is a schematic sectional view of the image forming apparatus in the first embodiment of the present invention, and shows the general structure of the apparatus.

Hereinafter, the first embodiment of the present invention is described with reference to FIGS. 1-6. To begin with, referring to FIGS. 1 and 2A and 2B, the image forming apparatus in this embodiment will be described about its general structure.

[Image Forming Apparatus]

The image forming apparatus 100 in this embodiment has: an image formation station Y which forms an image of yellow color; an image formation station M which forms an image of magenta color; an image formation station C which forms an image of cyan color; and an image formation station Bk which forms an image of black color. The four image formation stations are aligned in parallel (tandem) in the adjacencies of the intermediary transfer belt (intermediary transferring member, or another image bearing member of image forming apparatus 100), in the listed order, with preset intervals, in the direction parallel to the moving direction of the intermediary transfer belt.

There are disposed photosensitive drums 1*a*, 1*b*, 1*c*, and 1*d* in the image formation stations Y, M, C, and Bk, respectively. Further, there are disposed charge rollers 2*a*, 2*b*, 2*c*, and 2*d* in the adjacencies of the peripheral surface of the photosensitive drums 1*a*, 1*b*, 1*c*, and 1*d*, respectively. There are also disposed exposing devices 3*a*, 3*b*, 3*c*, ad 3*d*, developing devices 4*a*, 4*b*, 4*c*, and 4*d*, and drum cleaning devices 6*a*, 6*b*, 6*c*, and 6*d*, in the adjacencies of the peripheral surface of the photosensitive drums 1*a*, 1*b*, 1*c*, and 1*d*, respectively. There is stored yellow, magenta, cyan, and black toners, in the developing devices 4*a*, 4*b*, 4*c*, and 4*d*, respectively. Further, there are disposed primary transfer rollers 5*a*, 5*b*, 5*c*, and 5*d* in such a manner that the intermediary transfer belt 7 is sandwiched between the primary transfer rollers 5*a*, 5*b*, 5*c*, and 5*d*, and photosensitive drums 1*a*, 1*b*, 1*c*, and 1*d*, respectively. The area of contact between the peripheral surface of the photosensitive drum 1 and intermediary transfer belt 7 is the primary transfer station T1 (T1*a*, T1*b*, T1*c*, and T1*d*).

Next, the image formation process carried out in the above described image formation stations Y, M, C, and Bk is described. As an image forming operation is started by the image forming apparatus 100, first, the peripheral surface of the photosensitive drum 1*a* in the image formation station Y is charged by the application of charge bias to the charge roller 2*a*. Then, the charged portion of the peripheral surface of the photosensitive drum 1*a* is exposed by the exposing device 3*a*, based on the information of the yellow monochromatic image, that is, one of the multiple monochromatic images into which the image (full-color or multicolor image) to be formed has been separated. Consequently, an electrostatic latent image of the yellow monochromatic image is effected on the charge portion of the peripheral surface of the photosensitive drum 1*a*. This electrostatic image is developed by the combination of the developing device 4*a* and yellow toner, into a yellow toner image, that is, a toner image formed of yellow toner. The process similar to the above described one for forming a yellow monochromatic toner image is also carried out in the image formation stations M, C, and Bk to form the magenta, cyan, and black toner images, respectively.

Then, the toner images, different in color, formed through the above described processes, are sequentially transferred in layers onto the intermediary transfer belt 7, in the primary transfer stations T1*a*~T1*d* by the primary transfer biases applied to the primary transfer rollers 5*a*-5*d*, in the primary transfer stations T1*a*~T1*d*, respectively. As a result, a full-color toner image is effected on the intermediary transfer belt 7. The toner which failed to be transferred onto the intermediary transfer belt 7 in the primary transfer station T1*a*~T1*d*, and therefore, is remaining on the peripheral surface of the photosensitive drum, is removed by the drum cleaning device 6*a*, 6*b*, 6*c*, and 6*d*. The full-color toner image on the intermediary transfer belt 7 is transferred (secondary transfer) onto a sheet P of recording medium which was fed into the main assembly of the image forming apparatus by a pair of sheet feeder rollers 11, and then, was conveyed to the secondary transfer station 8, while the sheet P is conveyed through the secondary transfer station 8. Thereafter, the sheet P is separated from the roller of the secondary transfer station 8, and is conveyed to the fixation nip which is the area of contact between the fixation roller 9*a* and pressure roller 9*b* of the fixing device 9. Then, the sheet P is conveyed through the fixation nip while being subjected to the heat and pressure in the fixation nip. Thus, the full-color image becomes fixed to the sheet P. Then, the sheet P, which is bearing the fixed full-color image, is discharged from the apparatus main assembly of the image forming apparatus 100. The toner which failed to be transferred in the secondary transfer station 8 is removed by the belt cleaner 10.

Next, the structural components of the image formation station are described. Each of the photosensitive drums 1*a*~1*d* is a negatively chargeable organic photosensitive member (OPC), which is 30 mm, for example, in external diameter. It is rotationally driven at a process speed (peripheral velocity) of 200 mm/sec, for example, in the direction (counterclockwise direction: preset direction) indicated by an arrow mark in FIG. 1, by the driving force from a driving device (unshown). Each of the photosensitive drums 1*a*~1*d* is made up of an aluminum cylinder (electrically conductive substrate which is in the form of drum), and a charge transfer layer coated on the peripheral surface of the aluminum cylinder. The charge transfer layer is 18 μm, for example, in thickness. As the charge transfer layer is frictionally worn to a thickness of 13 μm, there occurs such a problem that the photosensitive drum 1 fails to be satisfactorily charged.

The amount by which the photosensitive drum 1 is shaved by the usage of the photosensitive drum 1 is affected by the method used to charge the photosensitive drum 1. More concretely, in a case where a photosensitive drum is charged with the use of an AC/DC-based charging method, which applies a combination of AC voltage and DC to charge the photosensitive drum, the thickness by which the photosensitive drum is frictionally shaved per 10,000 images is roughly 3 μm. In comparison, in a case where a photosensitive drum is charged with the use of a DC-based charging method which applies only DC voltage to charge the photosensitive drum, the thickness by which the photosensitive drum is frictionally shaved per 10,000 images is 1 μm. In other words, when a DC-based charging method is used, the photosensitive drum is longer in service life, and is smaller in the amount by which its charge transfer layer is shaved than when a AC/DC-based charging method, which is greater in the amount of discharge current than a DC-based charging method, is used. In this embodiment, therefore, a DC-based charging method which uses only DC voltage is used. More concretely, charge bias made up of only DC component is applied by electric power sources 22 and 25 as charge bias applying means, which will be described later.

The charge rollers 2*a*~2*d* are 320 mm, for example, in length in terms of their lengthwise direction (parallel to their rotational axis: direction perpendicular to sheet of paper on which FIG. 1 is drawn). They are structured in three layers. More concretely, they are made up of a metallic core, and a combination of a bottom layer, a middle layer, and a surface layer which are layered on the peripheral surface of the metallic core. The metallic core is formed of stainless steel and is 6 mm, for example, in diameter. The bottom layer is made of sponge of EPDM (ethylene-propylene-diene-rubber) which dispersedly contains carbon particles. It is in a range of $10^2$~$10^9$Ω in volume resistance, and 3.0 mm, for example, in thickness. The intermediary layer is a rubber layer formed of NBR (nitryl rubber) which dispersedly contains carbon particles. It is 700 μm, for example, in thickness. The surface layer is a protective layer, and is made of a mixture of fluorinated resinous compound, and carbon particles dispersed in the compound. It is in a range of $10^7$~$10^{10}\Omega$ in volume resistance. The overall volume resistance of each of the charge rollers 2*a*~2*d* is $10^5\Omega$, for example.

The charge rollers 2*a*~2*d* structured as described above are kept pressed toward the axial line of the photosensitive drums 1*a*~1*d*, respectively, by a preset amount of pressure, remaining therefore kept pressed upon the peripheral surface of the photosensitive drums 1*a*~1*d*, respectively. They are rotated by the rotation of the photosensitive drums 1*a*~1*d*, respectively. As charge bias is applied to the charge rollers 2*a*~2*d*, the peripheral surface of each of the photosensitive drums 1*a*~1*d* is charged to the preset potential level as will be described next.

In this embodiment, the image forming apparatus 100 is provided with a pair of electric power sources 22 and 25 for applying charge bias to charge rollers 2*a*~2*d*. More specifically, the electric power source 22 is shared by the charge rollers 2*a*, 2*b*, and 2*c* of the image formation stations Y, M, and C, respectively, whereas the power source 25 supplies charge bias only to the charge roller 2*d* of the image formation station Bk as will be described later. The image forming apparatus 100 is structured so that the primary transfer roller 5*a*, 5*b*, and 5*c* of the image formation stations Y, M, and C, respectively, can be pressed again, or moved away from, the photosensitive drums 1*a*, 1*b*, and 1*c*, respectively, together with the intermediary transfer belt 7. Further, the image forming apparatus 100 is capable of operating in the black monochromatic mode in which an image is formed by only the image formation station Bk, or, in the full-color mode, in which all of the four image formation stations Y, M, C, and Bk are used for image formation. In the black monochromatic mode, an image is formed after the primary transfer rollers 5*a*, 5*b*, and 5*c* are moved away from the photosensitive drums 1*a*, 1*b*, and 1*c*, respectively, by the charge roller positioning mechanism. As described above, the electrical power source for the image formation stations Y, M, and C is independent from the electric power source 25 for the image formation station Bk. In the black monochromatic mode, only the power source 25 for the image formation station Bk is activated.

In other words, the photosensitive drums 1*a*, 1*b*, and 1*c* in the image formation stations Y, M, and C in this embodiment are equivalent to the multiple image bearing members mentioned the aforementioned Japanese Laid-open Patent Application No. 2002-162801. Similarly, the charge rollers 2*a*, 2*b*, and 2*c* are equivalent to the multiple charging means, and the drum cleaning devices 6*a*, 6*b*, and 6*c* are equivalent to the multiple cleaning means. Further, the combinations of the exposing means 3*a*, 3*b*, and 3*c*, and the developing devices 4*a*, 4*b*, 4*c*, respectively, are equivalent to the multiple image forming means. Moreover, the primary transfer rollers 5*a*, 5*b*, and 5*c* are equivalent to the multiple transfer rollers which function as multiple transferring means, one for one. Incidentally, the image forming apparatus 100 may be structured so that its operational mode does not include the black monochromatic mode. In such a case, the image forming apparatus is to be structured so that the electric power source for applying charge bias to the image formation stations other than the charge roller 2*d* of the image formation station Bk is shared by the charge roller 2*d*. Further, the various structural components of the image formation station Bk are equivalent to the corresponding photosensitive drum and image forming means in the aforementioned Japanese patent application, like those in the other image formation stations.

As described above, in this embodiment, the peripheral surface of the photosensitive drum is charged by DC voltage alone. Therefore, the electric power sources (high voltage power source for charge bias) 22 and 25 are provided with DC voltage generation circuits 23 and 26, respectively. The power sources 22 and 25 are enabled to variably set the charge bias to be applied to the charge rollers. More specifically, the DC voltage generation circuits 23 are used to apply voltage to the charge rollers 2*a*, 2*b*, and 2*c*, whereas the DC voltage generation circuit 26 is used to apply voltage to only the charge roller 2*d*. The DC voltage (charge bias) is adjusted in value (magnitude by the adjustment circuits 24 and 27.

The value for the charge bias is set based on the detection results of the environmental sensor 51, with reference to a table (Table 1) prepared in advance, which will be described later. That is, in this embodiment, a control section (CPU) 60 as a controlling means determines the potential level to which the peripheral surface of the photosensitive drum is to be charged, based on the output of the environmental sensor 51, with reference to the table stored in a memory as a storing means. Then, it causes the power sources 22 and 25 to apply such charge bias that is calculated based on the determined potential level. The table contains potential levels (VD values) to which the peripheral surface of the photosensitive drum is to be charged, and variables such as the condition of the environment in which the image forming apparatus 100 is to be operated. The control section 60 obtains a proper charge bias level by adding the firing potential level Vth to the determined potential level. For example, when it is necessary to charge the peripheral surface of the photosensitive drum to −700V, the value of the charge bias is −1300 V, because the firing potential level was −600 V (Vth=−600 V) in this embodiment.

The environmental sensor 51 is disposed in the main assembly of the image forming apparatus 100. It detects the internal temperature and humidity of the apparatus main assembly. The control section 60 determines the potential level to which the peripheral surface of the photosensitive drum is to be charged, and also sets (determines) the transfer current of the primary transfer bias to be applied to the primary transfer rollers 5*a*~5*d*, based on the humidity (relative humidity) detected by the environmental sensor 51, as described above.

Each of the exposing devices 3*a*~3*d* has a semiconductor laser (unshown) which emits a beam of laser light while modulating the beam according to the information of the monochromatic images into which the image to be formed has been separated. The beam of laser light is projected upon the charged peripheral surface of the photosensitive drum after being transmitted by way of a polygon mirror, an f-θ lens, a deflection mirror, a dust cover glass, etc. (which are not shown). Consequently, an electrostatic latent image, which reflects the information of the image to be formed, is formed on the peripheral surface of the photosensitive drum.

Each of the developing devices 4*a*~4*d* has a developer container which can store two-component developer made up of toner and carrier. They charge the toner in the developer container to negative polarity, by stirring the toner and developer in the developer container. It has also a development sleeve on which the developer, or the mixture of the toner and carrier, is borne. It develops the electrostatic latent image formed on the peripheral surface of the photosensitive drum by applying a preset development bias to the development sleeve.

The intermediary transfer belt 7 is suspended, and kept tensioned, by multiple rollers. As a driver roller 7*b*, that is, one of the rollers by which the intermediary transfer belt 7 is suspended, is rotationally driven by a motor 7*a* as a kinetic driving force source, the intermediary transfer belt 7 circularly moves in the direction indicated by an arrow mark in FIG. 1. In this embodiment, a combination of the motor 7*a* and driver roller 7*b* makes up the moving means for moving the intermediary transfer belt 7.

The drum cleaning devices 6*a*, 6*b*, 6*c*, and 6*d* are devices for cleaning the photosensitive drums 1*a*, 1*b*, 1*c*, and 1 across their peripheral surface. More concretely, they have a cleaning blade, and remove transfer residual toner and the like contaminants from the peripheral surfaces of the photosensitive drums 1*a*, 1*b*, 1*c*, and 1, by placing their cleaning blade in contact with the peripheral surface of the photosensitive drums 1*a*, 1*b*, 1*c*, and 1, respectively.

Each of the primary transfer rollers 5*a*~5*d* is an elastic roller. It is made up of a metallic core, and an elastic layer which covers the virtually entirety of the peripheral surface of the metallic core. The primary transfer roller 5 is $5\times10^5$~$1\times10^6\Omega$ in volume resistivity, and 16 mm in diameter. More concretely, its metallic core is 320 mm, for example, in length, and 8 mm in diameter. It is made of stainless steel. The elastic layer is formed of an elastic material which contains ion-conductive substance. As the material for the elastic layer of the primary transfer roller 5, foamed polyurethane, foamed nitrile-budadiene-rubber (NBR), which contains an ion-conductive substance, may be listed, for example. In this embodiment, foamed NBR which contains an ion-conductive substance is used as the material for the elastic layer of the primary transfer roller 5. By the way, the material for the elastic layer of the primary transfer roller 5 may be foamed ethylene-propylene-diene rubber (EPDM) which dispersedly contains carbon black particles as an electron conductive substance. However, a roller, the elastic layer of which is formed of such a substance, is difficult to control in terms of the dispersion of carbon black particles, and also, in terms of electrical resistance. For example, it is difficult to mass-produce such a roller (primary transfer roller) while keeping the error in electrical resistance within a single unit of measurement (a range of $1\times10^9$~$1\times10^{10}$). In comparison, a roller (primary transfer roller), the elastic layer of which is formed of an elastic substance, which contains ion-conductive substance, is easier to control in terms of resistivity than a roller, the elastic layer of which is formed of a substance which contains carbon black particles.

Further, to the primary transfer rollers 5*a*, 5*b*, 5*c*, and 5*d*, the primary transfer bias is applied from electric power sources 50*a*, 50*b*, 50*c*, and 50*d*, respectively, as transfer bias applying means. The power sources 50*a*, 50*b*, 50*c*, and 50*d* from which the primary transfer bias is applied are different from the power sources for the charge bias, in that there are four of them to apply the primary transfer bias to the primary transfer rollers 5*a*, 5*b*, 5*c*, and 5*d*, respectively. The primary transfer rollers 5*a*, 5*b*, and 5*c* in the image formation stations Y, M, C in this embodiment are equivalent to the multiple transferring means disclosed in the aforementioned Japanese patent application. In a case where the image formation station Bk shares the charge bias power source for the other image formation stations, the combination of the primary transfer roller 5*d* and power source 50*d* is also equivalent to the transferring means.

The transfer current for each of the power source 50*a*, 50*b*, 50*c*, and 50*d* is set according to the results of the detection of the relative humidity by the environmental sensor 51. Further, the timing with which the primary transfer bias is applied is controlled by the control section 60, as will be described later.

In the case of the above described image forming apparatus 100, each photosensitive drum rotates while being kept in contact with the intermediary transfer belt 7 by the pressure from the primary transfer roller, and also, remaining in contact with the cleaning blade of the drum cleaning device. Therefore, the peripheral surface of the photosensitive drum is scarred and/or frictionally shaved by the intermediary transfer belt 7, cleaning blade, etc. Thus, it is not desirable that the photosensitive drums 1*a*, 1*b*, and 1*c* for forming yellow, magenta, and cyan images, rotate, while remaining in contact with the intermediary transfer belt 7, while the image forming apparatus 100 is in the black monochromatic mode.

Thus, in this embodiment, in order to prevent the photosensitive drum from being shaved and/or scarred, the image forming apparatus 100 is structured so that when it is in the black monochromatic mode, the intermediary transfer belt 7 is kept separated from the photosensitive drums which are not used in the black monochromatic mode, that is, the photosensitive drums 1*a*, 1*b*, and 1*c* for forming yellow, magenta, and cyan images, respectively. Therefore, the photosensitive drums 1*a*, 1*b*, and 1*c* for forming yellow, magenta, and cyan images, respectively, are prevented from being unnecessarily reduced in service life when the image forming apparatus is in the black monochromatic mode, in which they are not used.

Figure 2A:
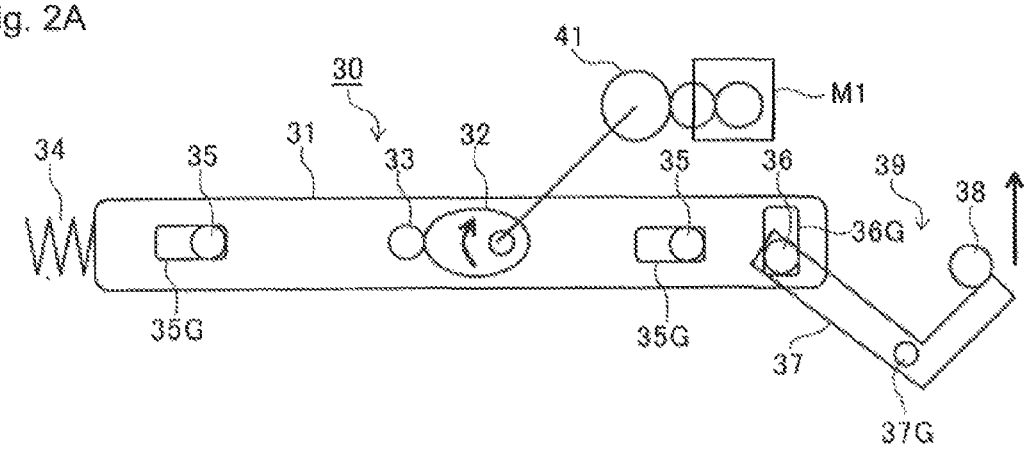
Figure 2B:
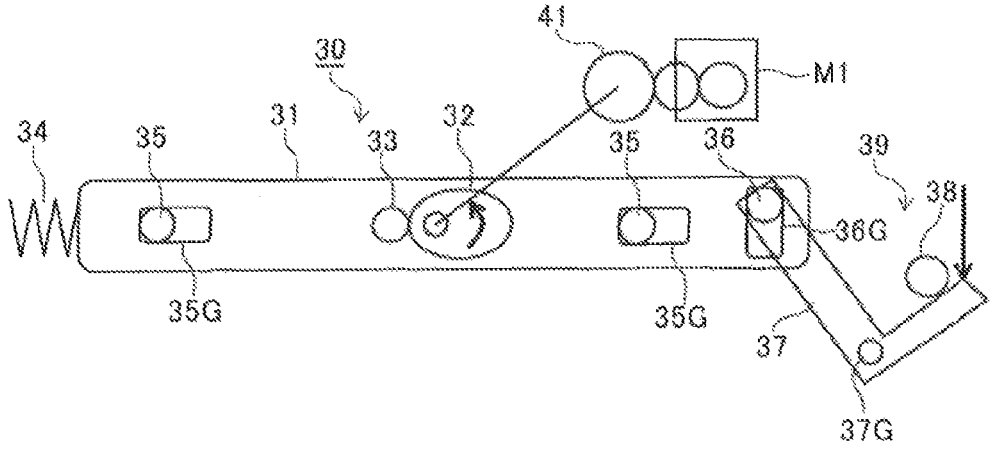

In this embodiment, in order to enable the image forming apparatus 100 to be operated in both the full-color and black monochromatic modes, the image forming apparatus 100 is provided with a mechanism 30 for moving the intermediary transfer belt 7 and primary transfer rollers 5*a*, 5*b*, and 5*c* away from the photosensitive drums 1*a*, 1*b*, 1*c*, respectively, as shown in FIGS. 2A and 2B. Next, this mechanism for moving the intermediary transfer belt 7 and primary transfer rollers 5*a*, 5*b*, and 5*c* away from, or back to, the photosensitive drums 1*a*, 1*b*, and 1*c*, respectively, is described in detail, with reference to FIGS. 2A and 2B, in which FIGS. 2A and 2B show the state of the mechanism 30 when the image forming apparatus 100 is in the full-color mode and black monochromatic mode, respectively.

Referring to FIG. 2B, when the image forming apparatus 100 is in the black monochromatic mode, a toner image (black) formed on the photosensitive drum 1*d* in the image formation station Bk, is transferred onto the intermediary transfer belt 7 while the intermediary transfer belt 7 and primary transfer rollers 5*a*, 5*b*, and 5*c* are kept separated from the photosensitive drums 1*a*, 1*b*, and 1*c*.

Referring to FIG. 2A, when the image forming apparatus 100 is in the full-color mode, four toner images (yellow, magenta, cyan, and black toner images) are transferred onto the intermediary transfer belt 7 while the intermediary transfer belt 7 is kept in contact with the photosensitive drums 1*a*, 1*b*, and 1*c*, as well as the photosensitive drum 1*d*.

The primary transfer roller positioning mechanism 30 has: a pivotal frame 39 which supports the primary transfer rollers 5*a*, 5*b*, and 5*c*; a pin 38 fixed to the pivotal frame 39; and an arm 37. It vertically moves the pin 38 with the use of the arm 37. It also has a slider 31, which is movable in the left-right direction of the drawing, while being guided by a pair of pins 35 fixed to the apparatus main assembly and fitted in a pair of long and narrow grooves 35G, with which the slider 31 is provided. It has also: a spring 34; a roller 33 fixed to the slider 31; and a cam 32. The spring 34 keeps the slider 31 pressed in the rightward direction of the drawing to keep the roller 33 in contact with the cam 32. The cam 32 is rotationally driven by a motor M1 through a kinetic driving force transmission mechanism 41, such as a gear train.

In the full-color mode, the cam 32 can move the slider 31 in the leftward direction of the drawing, that is, the direction to compress the spring 34, so that the pin 36 fixed to the arm 37 descends along the long and narrow groove 36G. As the pin 36 is made to descend, it causes the arm 37 to rotate counterclockwise about the pin 37G, to push the pin 38 upward. Consequently, the primary transfer rollers 5*a*, 5*b*, and 5*c* are made to press the intermediary transfer belt 7 upon the photosensitive drums 1*a*, 1*b*, and 1*c*, respectively.

In the black monochromatic mode, the cam 32 allows the slider 31, which is under the pressure generated by the spring 34, to move in the rightward direction indicated in the drawing, so that the pin 36 is made to move upward while being guided by the long and narrow groove 36G. As the pin 36 is moved upward, the arm 37 is rotated clockwise about the pin 37G by the movement of the pin 36, causing thereby the pin 38 to move downward. Consequently, the intermediary transfer belt 7 is moved away from the photosensitive drums 1*a*, 1*b*, and 1*c*, along with the primary transfer rollers 5*a*, 5*b*, and 5*c*.

[Pre-Exposure-Less Design]

In this embodiment, there are only the drum cleaning devices 6*a*~6*d* between the charge rollers 2*a*~2*d* and the primary transfer rollers 5*a*~5*d*, respectively, in terms of the moving direction (rotational direction) of the photosensitive drums 1*a*~1*d*. In other words, for the sake of cost reduction, the image forming apparatus 100 is not provided with a pre-exposing means, with which some image forming apparatuses are provided for optically removing the residual charge on the peripheral surface of a photosensitive drum (photosensitive drums 1*a*~1*d*) after the toner image transfer from the photosensitive drums. A pre-exposing device is a device for ridding the peripheral surface of the photosensitive drum of the residual charge (potential) before the photosensitive drum is charged after the transfer of the toner image from the photosensitive drum. It employs an LED chip array, a fuse lamp, a halogen lamp, a fluorescent lamp, or the like to rid the peripheral surface of the photosensitive drum of the residual charge (potential). It can rid the peripheral surface of the photosensitive drum of potential of the residual charge (potential) after the peripheral surface of the photosensitive drum is made nonuniform in potential by the transfer of the toner image from the peripheral surface of the photosensitive drum by the transfer bias. From the standpoint of preventing the generation of the "transfer memory," it is beneficial to optically rid the peripheral surface of the photosensitive drum electrostatic potential of the residual charge, with the use of a pre-exposing device after the transfer of a toner image from the peripheral surface of the photosensitive drum. In this embodiment, however, for the sake of cost reduction, the image forming apparatus 100 is not provided with a pre-exposing device. Thus, from the standpoint of preventing the generation of the "transfer memory," the image forming apparatus 100 in this embodiment is structurally disadvantageous.

[DC-Based Charging Method]

Further, in this embodiment, as described above, the electrical power sources 22 and 25 use the so-called DC-based charging method. The firing potential Vth is affected by the charge roller shape and/or contamination. Therefore, it has been known that the DC-based charging method is inferior to the AC/DC-based charging method, in terms of the level of uniformity to which the peripheral surface of the photosensitive drum is charged. Thus, an image forming apparatus which employs the DC-based charging method has been known to be inferior to an image forming apparatus which employs the AC/DC-based charging method, in terms of the uniformity of a toner image. On the other hand, it is free of the electrical discharge attributable to the AC component which the AC/DC-based charging method requires. Therefore, the DC-based charging method is less likely to deteriorate the photosensitive drum than the AC/DC-based charging method. That is, the drums of an image forming apparatus which uses the DC-based charging method are less likely to be shaved than the drums of an image forming apparatus which uses an AC/DC-based charging method. Therefore, the drums of an image forming apparatus which uses the DC-based charging method last longer than the drums of an image forming apparatus which uses the AC/DC-based charging method. Further, the DC-based charging device does not require an AC power source, and therefore, is meritorious in that it is less in cost than the AC/DC-based charging method charging device.

However, the DC-based charging method does not have the potential leveling effect which the AC component of the AC/DC-based charging method can provide. Further, the AC/DC-based charging method is superior to the DC-based charging method, in terms of the convergence of the potential, and therefore, is unlikely to fail to rid the peripheral surface of a photosensitive drum, of the "transfer memory," that is, the nonuniformity in potential, which is attributable to the transfer bias. For the reason given above, the DC-based charging method is disadvantageous compared to the AC/DC-based charging method, in terms of the generation of the "transfer memory."

[Sharing of Electrical Power Source for Charge Bias]

Further, in this embodiment, as described above, the image formation stations Y, M, and C share the electric power source 22 for applying the charge bias. Thus, only one charge bias power source 22 is required to supply the charge rollers 2*a*, 2*b*, and 2*c* of the image formation stations Y, M, and C, respectively, with voltage. Therefore, the image forming apparatus 100 in this embodiment is meritorious in that it is simpler to control, and also, significantly lower in the power source cost, than an image forming apparatus which has three high voltage power sources for the charge rollers 2*a*, 2*b*, and 2*c*, one for one.

However, in a case where a single charge bias power source is shared by two or more image formation stations (Y, M, and C), the more downstream a given image formation station (M, or C) relative to the most upstream image formation station Y, the longer the length of time which elapses before an image forming operation is started after the application of the charge bias. That is, the more downstream the given image formation stream, the greater it is in the amount of difference in potential level between a point of the peripheral surface of the photosensitive drum which was subjected to the transfer bias and a point of the peripheral surface of the photosensitive drum which was not subjected to the transfer bias, and therefore, more likely it is for the "transfer memory" to be generated. Thus, in order to prevent the generation of the "transfer memory", it is necessary to advance the timing with which the transfer bias is applied in the downstream image formation station. However, simply carrying out this control increases the transfer roller in electrical resistance, which in turn reduces the apparatus in its service life.

[Operational Sequences in this Embodiment]

In this embodiment, therefore, the image forming apparatus 100 is enabled to carry out the following two operational sequences. That is, in the case of the image forming apparatus 100 in this embodiment, it uses the DC-based charging method, and is not provided with a pre-exposing device as described above. Further, it is structured so that multiple image formation stations share a single charge bias power supply. Therefore, it is likely to generate the "transfer memory." Therefore, the image forming apparatus 100 in this embodiment is enabled to carry out the first sequence for dealing with the "transfer memory," or the second sequence which is to be carried out when the "transfer memory" is unlikely to be generated. Further, it is designed so that whether the first sequence is carried out or the second sequence is carried out is determined based on the potential level (VD) to which the peripheral surface of the photosensitive drum is to be charged. Therefore, it is possible to accomplish both the object of preventing the generation of the "transfer memory" and the object of minimizing the problem that the primary roller is reduced in service life by the primary transfer bias. Next, each of the two sequences is described.

[First Sequence]

The first sequence is for preventing the generation of the "transfer memory". It is carried out when the value set for the potential level VD is low in absolute value, that is, when carrying out the second sequence is likely to generate the "transfer memory." The first sequence is carried out when the value set for the potential level (VD) to which the peripheral surface of the photosensitive drum is to be charged is no more than a preset threshold value. More concretely, the timing with which the primary transfer bias is to be applied to the primary transfer rollers 5*a*~5*c* is controlled so that the following conditions are satisfied. That is, this timing is such a timing that a toner image is formed by the combination of the exposing devices 3*a*~3*c* and the developing devices 4*a*~4*c*, respectively, across the portion of the peripheral surface of each of the photosensitive drums 1*a*~1*c*, which was subjected to the charge bias and primary transfer bias, and then, was subjected to the charge bias for the second time. More concretely, in the first sequence, the control section begins to apply the primary transfer bias with such a timing that the point of the peripheral surface of each of the photosensitive drums 1*a*~1*c*, at which the peripheral surface of the photosensitive drum begins to be charged, arrives at the primary transfer stations T1*a*~T1*c*, respectively.

Figure 3:
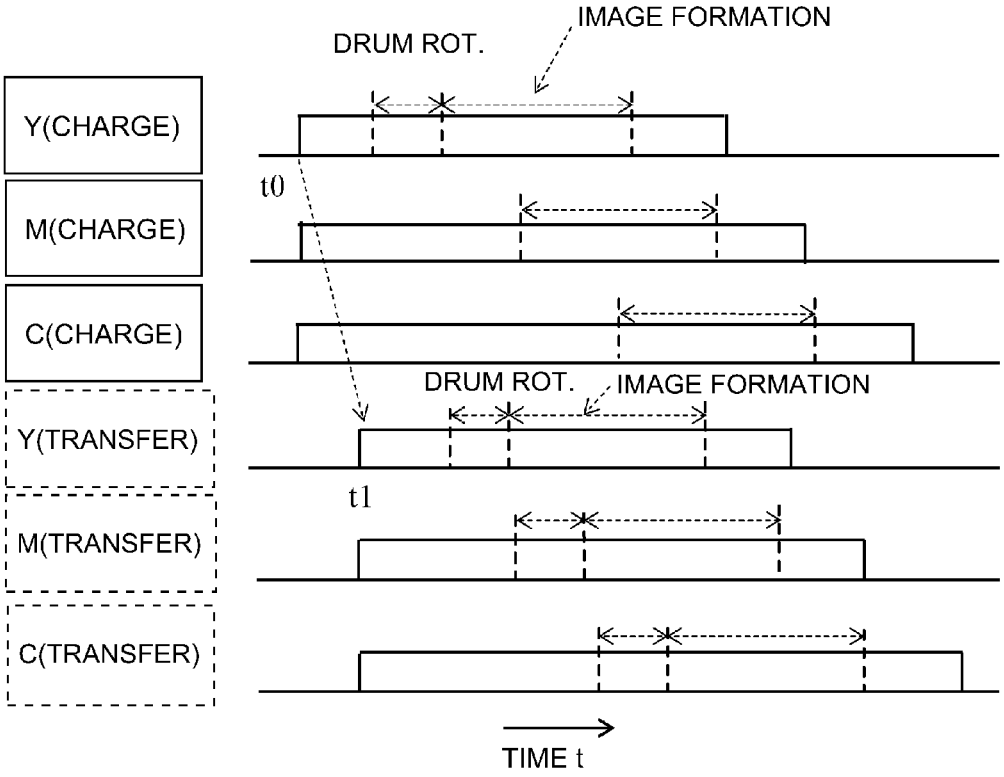
FIG. 3 is a schematic drawing for showing the timing with which the charging bias and transferring bias are applied in the first sequence, in each image formation station, in the first embodiment.
Figure 4:
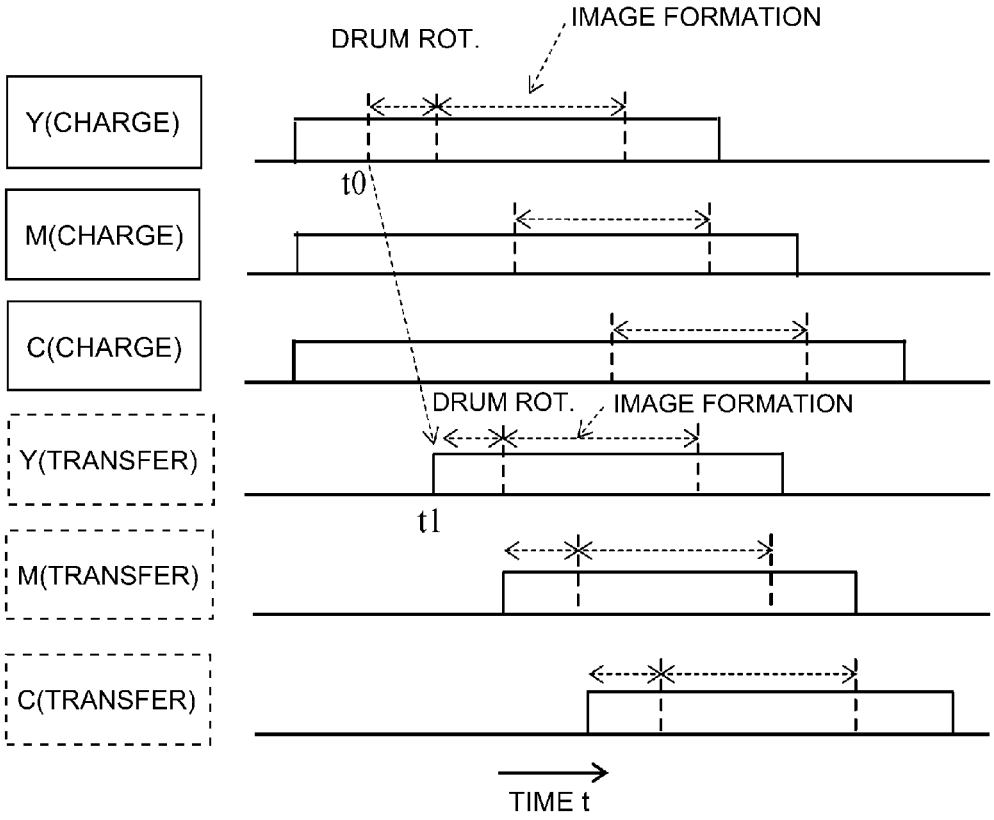
FIG. 4 is a schematic drawing for showing the timing with which the charging bias and transferring bias are applied in the second sequence, in each image formation station, in the first embodiment.

That is, referring to FIG. 3, in this embodiment, the timing with which the primary transfer bias begins to be applied in the downstream image formation station is advanced. That is, the primary transfer bias begins to be applied at roughly the same point (t1) in time, at which the point of the "image formation area" of the drum, to which charge bias began to be applied at a point (t0) in time, for the first time, arrives.

The expression "roughly the same" means that in terms of the rotational direction of the photosensitive drum, an error which is equivalent to roughly 5 mm is acceptable. However, in order to prevent the primary transfer bias from being applied to the point of the peripheral surface of the photosensitive drum, to which the charge bias has not been applied, the primary transfer bias has to begin to be applied before the point of the "image formation area" at which the charge bias began to be applied, arrives at the primary transfer station, so that it is ensured that the error will be on the positive side, with reference to the point at which the charge bias began to be applied. With this arrangement, it is ensured that the charged portion of the peripheral surface of the photosensitive drum is always subjected to the primary transfer bias. Therefore, the problem that the point of the peripheral surface of the photosensitive drum, which has been affected by the primary transfer bias, and that which has not been affected by the primary transfer bias, become different in potential level after they are charged, can be prevented. That is, the generation of the "transfer memory" can be prevented.

Also in this embodiment, the timing with which the charge bias begins to be applied is such that the point in time at which the charge bias begins to be applied to the image forming area is a preset length of time, which is equivalent to two full rotations (drum), before a latent image begins to be written on the image formation area. More concretely, in the image formation station Y, or the most upstream image formation station, the application of the charge bias is started at a point in time, which is a preset length of time (which is equivalent to two full rotations of the photosensitive drum) before a latent image begins to be formed on the image formation area, for the following reason. That is, in this embodiment, the DC-based charging method is employed, which is not as desirable as the AC/DC-based charging method, in that the former is not meritorious in terms of the convergence of the electrical charge of the peripheral surface of the photosensitive drum to the preset level. Therefore, if the application of charge bias is started at a point in time which is a preset length of time (which is equivalent to only a single full rotation of photosensitive drum) before the starting of the formation of a latent image on the image formation area, it is possible that the potential of the image formation area will have not reached the preset level. This is why the application of the charge bias is started a preset length of time, which is equivalent to two or more full rotations of the photosensitive drum, before the starting of the formation of a latent image. The image formation stations M and C, which are on the downstream side of the image formation station Y, are made to be the same in the timing with which the charge bias and primary transfer bias begin to be applied. Therefore, also in the image formation stations M and C, the charge bias and primary transfer bias are applied for no less than a length of time which is equivalent to two or more full rotations of photosensitive drum.

[Second Sequence]

The second sequence is for preventing the primary transfer roller from being reduced in the length of service life. It is to be carried out when the potential level VD is large in absolute value, that is, when it is unlikely for the "transfer memory" to be generated. That is, in the second sequence, when the absolute value of the potential level VD for the charge bias is larger than a preset threshold value, the timing with which the primary transfer bias is applied to the primary transfer rollers 5*a*~5*c* is delayed compared to the first sequence. That is, referring to FIG. 4, in the second sequence, the image formation stations Y, M, and C are the same in the timing with which the charge bias begins to be applied, but, are sequential in the timing with which the primary transfer bias begins to be applied. In this embodiment, in each image formation station, the primary transfer bias begins to be applied as the point of the peripheral surface of the photosensitive drum, at which the charge bias begins to be applied during the immediately preceding rotation of the photosensitive drum, arrives at the primary transfer station. From the standpoint of preventing the generation of the "transfer memory," the second sequence is disadvantageous compared to the first sequence. However, when the set potential level VD is high, the "transfer memory" is unlikely to be generated even when the second sequence is carried out.

By the way, also in the second sequence, all of the primary transfer roller 5*a*~5*c* may be the same in the timing with which the primary transfer bias begins to be applied to them. However, it is desired that the timing with which the primary transfer bias is applied to the downstream primary transfer roller in terms of the direction in which the intermediary transfer belt 7 is moved, is delayed relative to the timing with which the primary transfer bias is applied to the upstream primary transfer roller.

In this embodiment, therefore, the primary transfer rollers 5*a*~5*c* are provided with the first transferring means (primary transfer roller 5*a*, for example), and the second transferring means (primary transfer roller 5*b* or 5*c*, for example) which is on the downstream side of the first transferring means in terms of the moving direction of the intermediary transfer belt 7. In the second sequence, the control section 60 delays the second transferring means relative to the first transferring means in terms of the timing of the primary transfer bias application. In this embodiment, the more downstream the image formation station, the later the station in terms of the timing with which the primary transfer bias is applied to the primary transfer roller. Incidentally, the primary transfer rollers 5*a* and 5*b* may be the same in the timing with which the primary transfer bias is applied to them, and so may be the primary transfer rollers 5*b* and 5*c*.

[Relationship Between VD and Transfer Memory]

Figure 5:
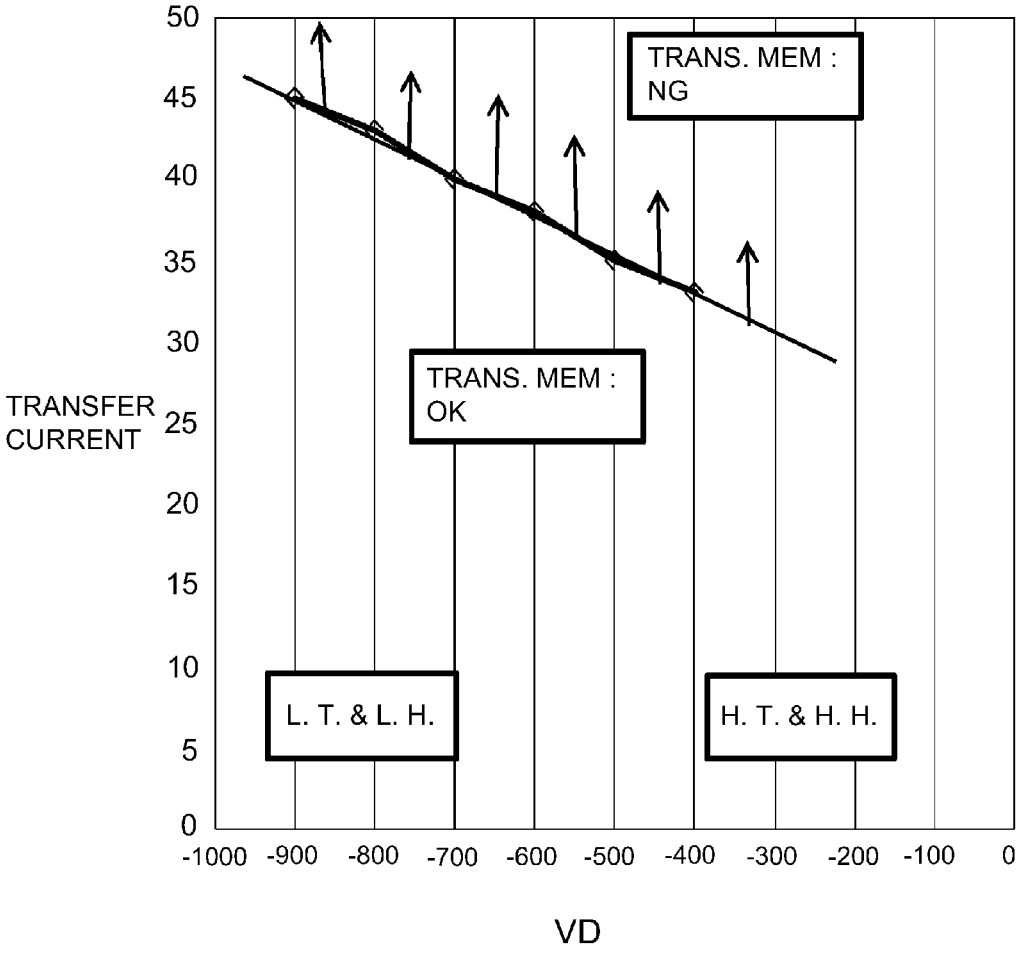
FIG. 5 is a graph which shows the area in which the "transfer memory" is likely to be generated by the relationship between the potential level of the charge on the peripheral surface of the photosensitive drum and the transfer current, and the area in which the "transfer memory" is unlikely to be generated by the relationship.
Figure 6:
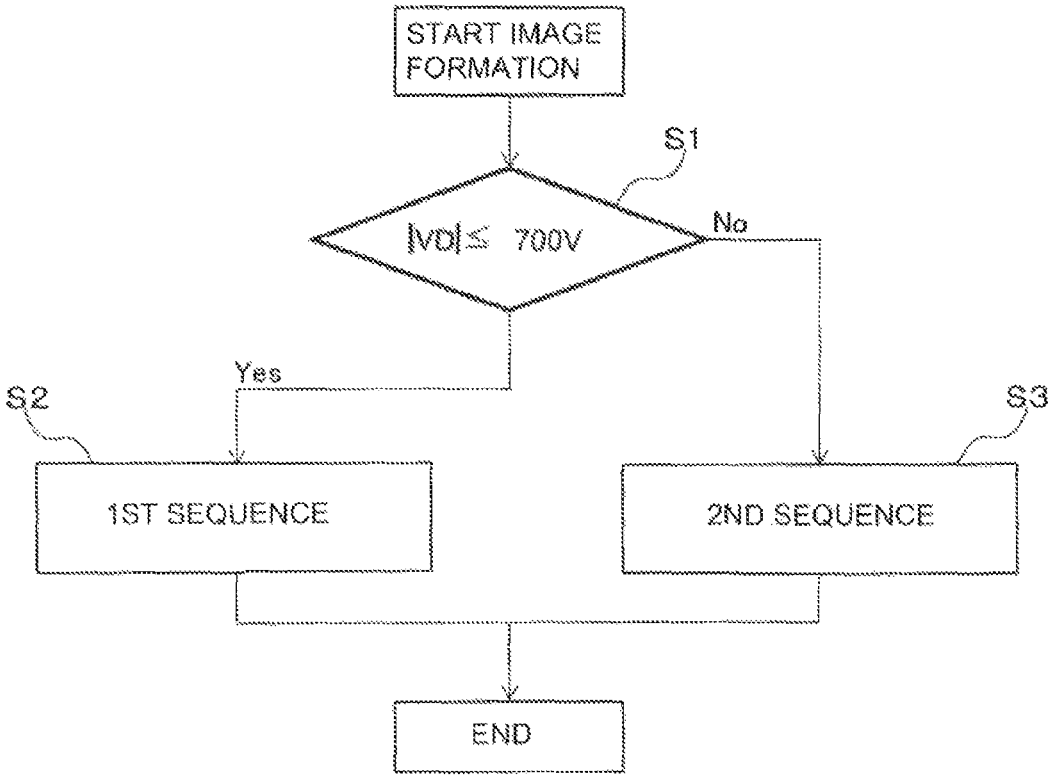
FIG. 6 is a flowchart which shows the flow of a part of the control sequence in the first embodiment.

Next, referring to FIG. 5, the relationship between the VD (pre-exposure potential level) and transfer memory is described. FIG. 5 is a graph which shows the relationship among the pre-exposure potential level VD, transfer bias (transfer current), and the threshold value for the transfer current to which the "transfer memory" is attributable. As described above, in a low temperature-low humidity environment, the VD needs to be set high, whereas in the high temperature-high humidity environment, the VD needs to be set to be low. Further, in FIG. 5, the slanted line stands for the threshold voltage (current) above which the "transfer memory" is likely to occur (NG), and below which the "transfer memory" is unlikely (OK) to occur. As will be evident from FIG. 5, from the standpoint of preventing the generation of the "transfer memory," the higher the VD in absolute value relative to the amount of the transfer current, the better, assuming (when) the amount by which transfer current is flowed by the transfer bias remains the same.

[Switching of Sequence]

In this embodiment, the switching between the first and second sequences is made based on the value to which pre-exposure potential level VD is set. That is, as described above, in a case where the value to which the pre-exposure potential level VD is set is no more than the preset threshold value, the first sequence is carried out, whereas in a case where the preset pre-exposure potential level VD is no less than the preset threshold value, the second sequence is carried out. The value to which the pre-exposure potential level VD is set is obtained from a table such as Table 1, based on the environmental condition (relative humidity) detected by the environmental sensor 51. Table 1 shows the relationship among the relative humidity detected by the environmental sensor 51, pre-exposure potential level of the photosensitive drum, and amount of transfer current.

TABLE 1

| Relative Humidity (%) | 0 | 10 | 20 | 30 | 40 | 50 | 60 | 70 | 80 | 90 |
|---|---|---|---|---|---|---|---|---|---|---|
| VD set (V) | −800 | −780 | −760 | −730 | −700 | −650 | −580 | −530 | −510 | −500 |
| Transfer Current (μA) | 35 | 35 | 33 | 33 | 30 | 30 | 27 | 27 | 25 | 25 |

The VD values in Table 1 are preset values for keeping stable the amount by which toner is adhered to the peripheral surface of the photosensitive drum per unit area. They are set based on the temperature and humidity of the environment in which the apparatus main assembly is operated. That is, this control is for keeping stable at a preset level the amount by which toner is adhered to the peripheral surface of the photosensitive drum per unit area, regardless of the amount of the electrical charge of toner. Therefore, when the image forming apparatus is operated in an environment which is low in relative humidity, and therefore, toner will be greater in the amount of electrical charge, the pre-exposure potential level VD is set higher to increase the development contrast, that is, the difference between the development bias Vdc and post-exposure potential level VL. On the other hand, when the image forming apparatus is operated in an environment which is high in relative humidity, and therefore, toner is less in the amount of electrical charge, the VD is set low to reduce the development contrast, that is, the difference between the development bias Vdc and post-exposure potential level VL.

Referring to Table 1, in this embodiment, when the relative humidity is no more than 40%, the transfer current setting is no less than 30 μA. In this case, as long as the pre-exposure potential level VD is set to −700 V (absolute) value, the "transfer memory" is unlikely to occur even if the second sequence is carried out. Therefore, −700 V is used as the threshold value for making a switch between the first and second sequences. That is, referring to FIG. 6, as an image forming operation is started, the control section 60 sets a value for the pre-exposure potential level VD, based on the relative humidity detected by the environmental sensor 51. Then, the control section 60 determines whether or not the value set for the pre-exposure potential level VD is no more than 700 V (absolute value) (S1). If the absolute value of the value set for the pre-exposure potential level VD is not more than 700 V, the control section 60 carries out the first sequence (S2). If the absolute value of the value set for the pre-exposure potential level VD is more than 700 V, it carries out the second sequence (S3). In this embodiment, the threshold value for making a switch between the first and second sequences is set to −700 V. However, this embodiment is not intended to limit the present invention in terms of this particular threshold value; the threshold value can be set to other values.

In an image forming operation in which multiple images are to be continuously formed (multiple sheets of paper are continuously conveyed), it is while the first sheet of paper is conveyed that the "transfer memory" is most likely to be generated; it is less likely for the "transfer memory" to be generated while the second sheet of paper, and those thereafter, are conveyed, for the following reason. That is, while multiple images are continuously formed (multiple sheets of paper are continuously conveyed), the primary transfer bias is not turned off in the sheet intervals. In other words, the primary transfer bias is continuously applied to the photosensitive drum. Therefore, it is unlikely for the peripheral surface of the photosensitive drum to be made nonuniform in electrical potential by the primary transfer bias. In this embodiment, therefore, when multiple images are continuously formed, the charge bias and primary transfer bias are continuously applied in each of the image formation stations.

In the case of the image forming apparatus in this embodiment structured as described above, if the value to which the pre-exposure potential level VD is to be set is no more than a preset threshold value in terms of absolute value, that is, when the "transfer memory" is likely to be generated, the control section 60 carries out the first sequence to prevent the generation of the "transfer memory." On the other hand, when the value to which the pre-exposure potential VD is set is no less than the preset threshold value in terms of absolute value, that is, when the "transfer memory" is unlikely to be generated, the control section 60 carries out the second sequence to prevent the length of time the primary transfer bias t is applied to the primary transfer rollers 5*a*, 5*b*, and 5*c*. Thus, not only is it possible to prevent the generation of the "transfer memory", but also to prevent the problem that the primary transfer rollers 5*a*, 5*b*, and 5*c* are reduced in service life by the increase in the electrical resistance of the primary transfer rollers 5*a*, 5*b*, and 5*c*, respectively.

That is, when the value to which the pre-exposure potential level VD is set is low, and therefore, the "transfer memory" is likely to be generated, the first sequence is carried out to advance the timing with which the primary transfer bias begins to be applied, in order to prevent the generation of the "transfer memory." This practice makes longer the length of time the transfer bias is applied. In this embodiment, however, the condition for reducing the value to which the pre-exposure potential level VD is to be set is that the environment is high in both temperature and humidity. Therefore, the primary transfer roller remains low in electrical resistance. Therefore, even if the primary transfer roller increases in electrical resistance, the primary transfer bias which is applied to the primary transfer roller is lower than that which is applied to the primary transfer roller when the environment is low in both temperature and humidity. Thus, there is no serious ill effect upon the length of the service life of the primary transfer roller.

On the other hand, when the value to which the pre-exposure potential level VD is to be set is high, and therefore, the "transfer memory" is unlikely to be generated, the control section 60 carries out the second sequence which does not advance the primary transfer bias application timing, to prevent the generation of the "transfer memory." That is, when the image forming apparatus is operated in an environment which is low in both temperature and humidity, and therefore, requires the pre-exposure potential level VD to be set high, the primary transfer roller increases in electrical resistance, and therefore, is likely to reduce the primary transfer roller in the length of its service life. However, the "transfer memory" is less likely to generated. Therefore, the second sequence may be shorter in the length of time the primary transfer bias is applied than the first sequence. Therefore, carrying out the second sequence can prevent the primary transfer roller from increasing in electrical resistance, and therefore, can prevent the primary transfer roller from being reduced in service life.

Further, if the image formation stations Y, M, and C are made the same in the primary transfer bias application timing as in the first sequence, the more downstream a given image formation station, the longer it is in the length of time the primary transfer bias is applied, and therefore, the faster it is increased in electrical resistance by passage of electric current. Therefore, in the second sequence, the second transferring means, that is, the downstream transferring means, is made to be later in the timing with which the primary transfer bias is applied than the first transferring means. In particular, in this embodiment, the more downstream a given image formation station, the later it is in the timing with which the primary transfer bias is applied. Therefore, it is possible to prevent the problem that the more downstream a given primary transfer roller, the shorter it is in the length of service life.

In this embodiment, the image forming apparatus is structured so that one of the two electric power sources for charge bias is shared by the three image formation stations, and also, so that it uses the DC-based charging method. Further, it is not provided with a pre-exposing device, as described above. Therefore, it is significantly lower in cost than an image forming apparatus in accordance with the prior art, that is, an image forming apparatus equipped with a pre-exposing device. Even through it uses the DC-based charging method, is structured so that one of the two electric power sources for charge bias is shared by the three image formation stations, and is not provided with a pre-exposing device, as described above, it can be switched in operational sequence between the first sequence which is for preventing the generation of the "transfer memory", and the second sequence which is for preventing the primary transfer roller from being reduced in the length of its service life. Therefore, the image forming apparatus in this embodiment can prevent both the generation of the "transfer memory," and the reduction of the length of the service life of the primary transfer roller. That is, not only can this embodiment of the present invention reduce the image forming apparatus in cost, but also, can prevent both the generation of the "transfer memory", and the reduction in the length of the service life of the primary transfer roller.

Second Embodiment

Figure 7:
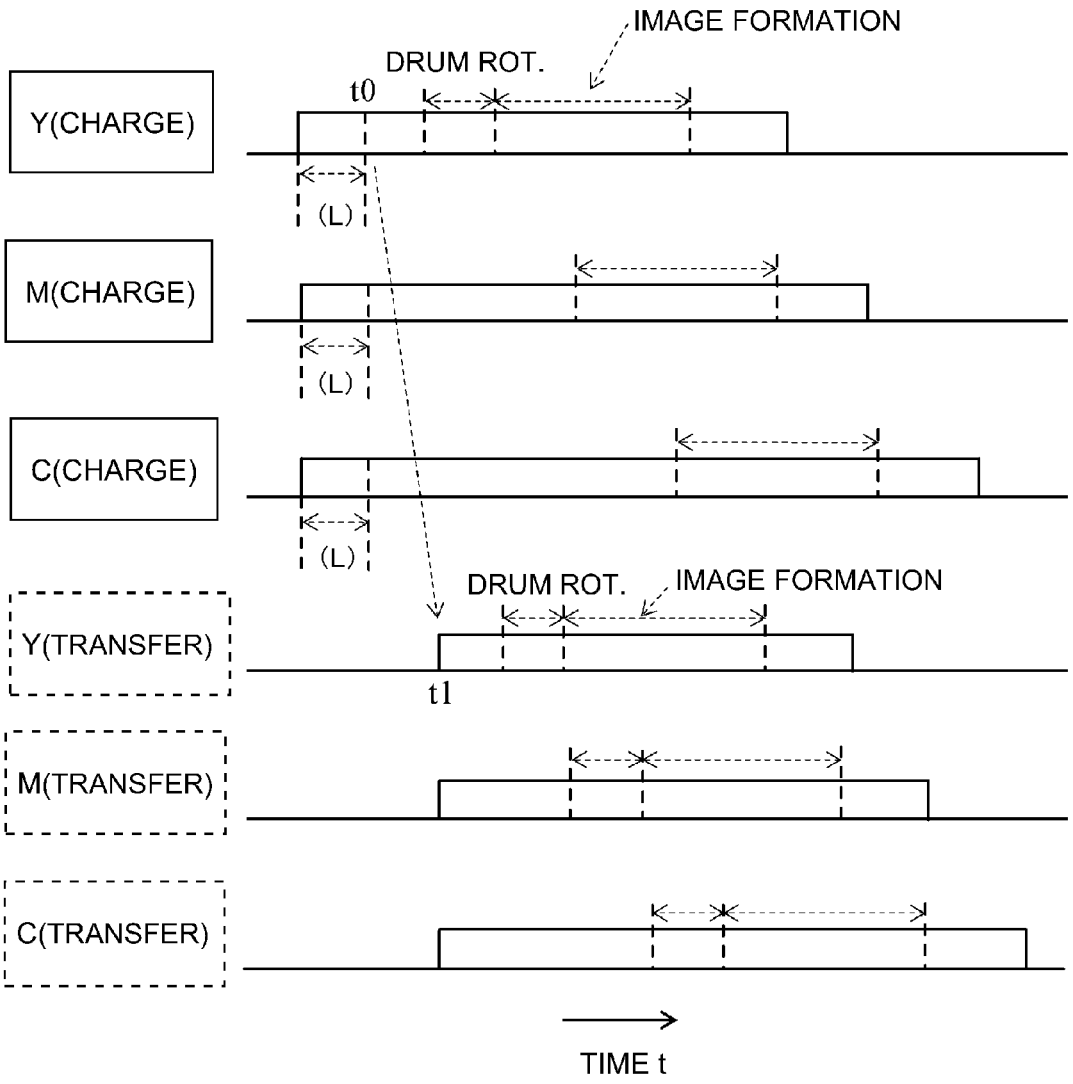
FIG. 7 is a schematic drawing for showing the timing with which the charging bias and transferring bias are applied in the first sequence, in each image formation station, in the second embodiment.
Figure 8:
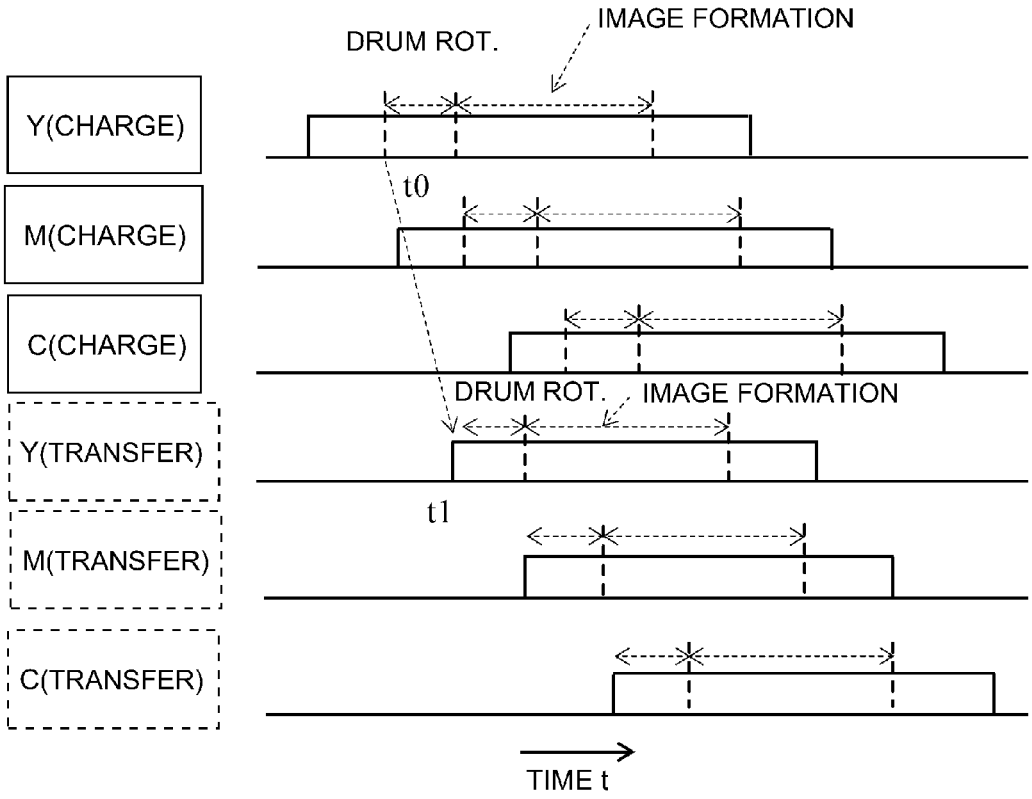
FIG. 8 is a drawing for showing an example of the timing with which the charging bias and transferring bias are applied in consideration of the generation of the "transfer memory", in each image formation station.
Figure 9:
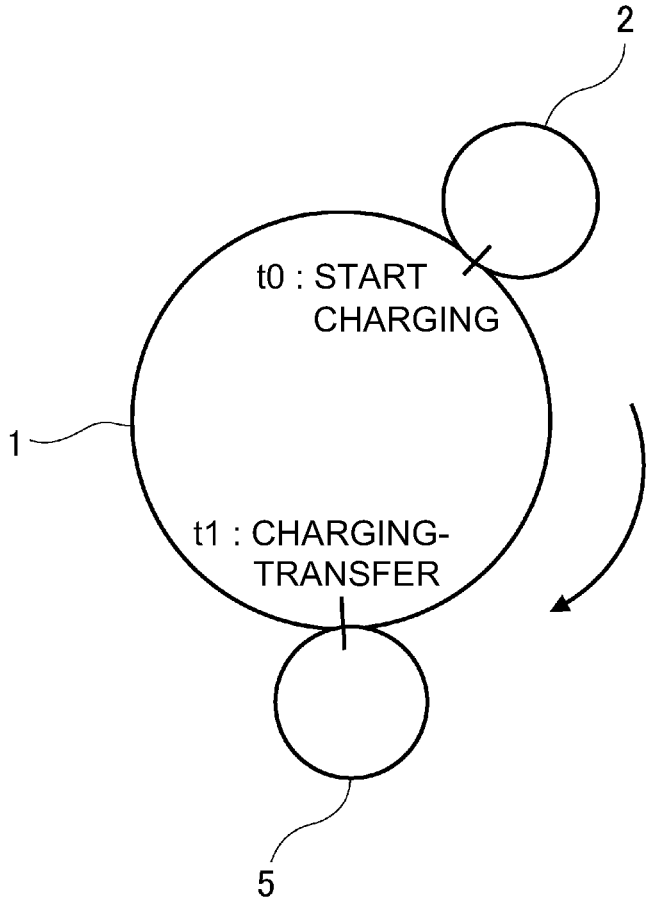
FIG. 9 is a schematic drawing for showing the positional relationship of the charge roller and transfer roller relative to the photosensitive drum in each image formation station, and also, the points in time at which a given point on the peripheral surface of the photosensitive drum arrives at the charge roller and transfer roller, as the photosensitive drum is rotated in each image formation station.

Next, referring to FIG. 7 along with FIG. 1, the second embodiment of the present invention is described. Also in this embodiment, the switching is made between the first and second sequences, based on the value to which the pre-exposure level VD is set according to Table 1, as in the first embodiment. The second sequence in this embodiment is the same as the second sequence in the first embodiment, but the first sequence in this embodiment is different from the first sequence in the first embodiment. FIG. 7 is a schematic drawing for showing the first sequence in this embodiment.

In the case of the first sequence in the first embodiment, the timing with which the primary transfer bias is applied is delayed by a length of time which is equivalent to a length of L of the peripheral surface of the photosensitive drum in terms of the rotational direction of the photosensitive drum, relative to the timing with which the charge bias is applied. That is, the primary transfer bias is applied after the elapse of a length of time, which is equivalent to the length L of the peripheral surface of the photosensitive drum in terms of the rotational direction of the photosensitive drum, relative to the point of the peripheral surface of the photosensitive drum, which corresponds to the point in time at which the charge bias began to be applied. In other words, the primary transfer bias is applied with such a timing that the point of the peripheral surface of the photosensitive drum, which is upstream by a length L in terms of the rotational direction of the photosensitive drum, from the point of the peripheral surface of the photosensitive drum, which corresponds to the point in time (t0) at which the photosensitive drum began to be charged after the starting of a given image forming operation, reaches the primary transfer station (t1). Therefore, there occurs on the peripheral surface of the photosensitive drum, an area, to which the primary transfer bias is not applied, and the length (dimension) of which in terms of the rotational direction is L.

As described above, in order to ensure that the peripheral surface of the photosensitive drum is charged to a preset potential level, it is desired that the charge bias is applied for a length of time which is equivalent to two or more full rotations of the photosensitive drum. On the other hand, from the standpoint of preventing the primary transfer roller from being reduced in service life by the application of the primary transfer roller, the length of time the primary transfer bias is applied is desired to be as short as possible. In this embodiment, therefore, in consideration of these issues, the timing with which the primary transfer bias is applied is delayed, within a range which ensures that the peripheral surface of the photosensitive drum is charged to a preset potential level, and yet, the effects of the "transfer memory" are negligible. However, even in this case, such control is executed that ensures that it will be the portion of the peripheral surface of the photosensitive drum, which has been subjected to the charge bias and primary transfer bias during the immediately preceding rotation of the photosensitive member, and then has been subject to the charge bias (for the second time) during the current rotation of the photosensitive drum, that reaches the first portion of the image formation area.

In the first sequence in the second embodiment, there occurs on the peripheral surface of the photosensitive drum, an area which was subjected to the charge bias, but was not subjected to the primary transfer bias, and the dimension of which in terms of the rotational direction of the photosensitive drum is L. This area of the peripheral surface of the photosensitive drum is different in potential level from the area of the peripheral surface of the photosensitive drum which was subjected to both the charge bias and the primary transfer bias. Therefore, the first sequence in this embodiment may be disadvantageous to the first sequence in the first embodiment, in terms of the "transfer memory." On the other hand, the first sequence in this embodiment can reduce the length of time bias is applied to the primary transfer roller, compared to the first sequence in the first embodiment. Therefore, it can minimize the primary transfer roller in the increase in its electrical resistance, in a case in which the primary transfer roller is low in electrical resistance, even when the environment in which the image forming apparatus is operated is such that the pre-exposure potential level VD is low. In such a case, by setting the length L to an optimal value, according to the expected level of the "transfer memory," it is possible to accomplish both the objective of dealing with the "transfer memory," and also the objective of minimizing the issue that the primary transfer roller is reduced in service life by the application of the primary transfer bias. In this embodiment, the value for L was set to 94.2, which is the circumference of the photosensitive drum. As a result, the "transfer memory" was negligible.

Also in this embodiment, the image formation stations Y, M, and C were made the same in the primary transfer application timing. However, the timing may be set so that the more downstream it is, the later the primary transfer bias application timing, provided that the image forming apparatus is operated in an environment in which the "transfer memory" is unlikely to be generated. That is, in this embodiment, one of the two electrical power sources for charge bias is shared by the three image formation stations. Therefore, the more downstream it is, the longer the length of time the primary transfer bias is applied is likely to be. Therefore, the more downstream a given primary transfer roller, the shorter it will become in service life. Therefore, even when the image forming apparatus is operated in an environment in which the "transfer memory" is unlikely to be generated, it is desired that an image forming apparatus is structured so that the more downstream a given image formation station is positioned, the later it is in the timing with which the primary transfer bias is applied.

In this embodiment, even when the first sequence is carried out, it is possible to reduce the length of time the primary transfer bias is to be applied. Therefore, it is possible to prevent the primary transfer roller from reducing in service life. The structure and function of the components of the image forming apparatus in this embodiment other than the above described ones are the same as the counterparts in the first embodiment.

The image forming apparatuses in each of the above described embodiments of the present invention were of the intermediary transfer type, and therefore, they transferred the toner image formed on their photosensitive drums onto their intermediary transfer belt. However, the present invention is also applicable to an image forming apparatus of the so-called direct transfer type, which directly transfers the toner image (s) it forms on its photosensitive drum(s), onto a sheet of recording medium. In the case of an image forming apparatus of the so-called direct transfer type, a sheet of recording medium is equivalent to the intermediary transfer belt, or the second image bearing member, and the means for conveying a sheet of recording medium, for example, a recording medium conveyance belt, is equivalent to the image conveying means.

Also in each of the above described embodiments, the toner was charged to the negative polarity, and so was the photosensitive drum. Further, the positive voltage was applied as the transfer bias. However, the present invention is also applicable to an image forming apparatus, which is opposite in the polarity to which the toner and photosensitive drum are charged, and also in the polarity of the transfer bias, from the image forming apparatuses in the preceding embodiments.

According to the present invention, when the value for the potential level to which the peripheral surface of the photosensitive drum is to be charged is no more in absolute value than a preset threshold value, and therefore, the "transfer memory" is likely to be generated, the control section carries out the first sequence to prevent the generation of the "transfer memory." On the other hand, when the potential level to which the peripheral surface of the photosensitive drum is to be charged is no less in absolute value than a preset threshold value, the control section carries out the second sequence to reduce the length of time the transfer bias is applied to the transferring means. Therefore, not only is it possible to prevent the generation of the "transfer memory", but also to prevent the transferring means from being reduced in the length of its service life, by the increase in the electrical resistance of the transferring means.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 283305/2012 filed Dec. 26, 2012, which is hereby incorporated by reference herein.

What is claimed is:

1. An image forming apparatus comprising:

a plurality of photosensitive members;

charging members configured to be supplied with charging bias voltages to charge surfaces of said photosensitive members at charge portions, respectively;

exposure members configured to effect image exposure of said photosensitive members charged by said charging members on the basis of image signals at image regions, respectively;

developing devices configured to deposit toners onto the surfaces of said photosensitive members exposed by said exposure members to form toner images thereon, respectively;

transfer members configured to be supplied with transfer bias voltages to transfer the toner images deposited on the surfaces of said photosensitive members by said developing devices, respectively, onto an intermediary transfer member or a recording material carried on a recording material feeding member at transfer portions, respectively;

a common charging bias voltage source configured to apply the charging bias voltages to said charging members in accordance with set points of charged potentials, respectively;

transfer bias voltage sources configured to carry out applications of the transfer bias voltages to said transfer members at predetermined timings, respectively; and a controller configured to execute, when an absolute value of a set point of a charged potential is not higher than a predetermined threshold, an operation in a first mode, in which application of the charging bias voltage is started at a timing not less than a preset length of time, which is a time equivalent to two or more full rotations of said photosensitive members, before starting of formation of a latent image on the image region, in each of said photosensitive members, and application of the transfer bias voltage is started at a timing after a preset length of time from the start of the application of the charging bias voltage, which is a time required for a predetermined peripheral position of each of said photosensitive members to move from the charge portion to the transfer portion, and said controller being further configured to execute, when the absolute value of the set point of the charged potential is higher than the predetermined threshold, an operation in a second mode in which timings of a start of applications of the transfer bias voltages to said transfer members are delayed as compared with those in the first mode, respectively.

2. The apparatus according to claim 1, further comprising a driving source for moving said intermediary transfer member or said recording material feeding member, wherein said transfer members include first transfer members and second transfer members provided downstream of said first transfer members with respect to a moving direction of said intermediary transfer member or said recording material feeding member, respectively, and wherein said controller delays, in the second mode, timing of the applications of the transfer bias voltages to said second transfer members, as compared with timing of the applications of the transfer bias voltages to said first transfer members.

3. The apparatus according to claim 1, wherein no pre-exposure members for exposing said photosensitive members to light in respective regions upstream of said charging members and downstream of said transfer members with respect to a moving direction of said photosensitive members are provided.

4. The apparatus according to claim 1, wherein said common charging bias voltage source applies to said charging members the charging bias voltages containing only a DC component.

5. The apparatus according to claim 1, wherein each of said transfer members includes a transfer roller containing ion electroconductive material.

6. The apparatus according to claim 1, further comprising an ambient condition sensor for detecting a humidity in a main assembly of said apparatus, wherein said controller sets the set points of the charged potentials on the basis of a result of detection of said ambient condition sensor.

* * * * *